US005085324A

United States Patent [19]

Dehlén

[11] Patent Number: 5,085,324

[45] Date of Patent: Feb. 4, 1992

[54] SCREEN FOR PROCESSING CONVEYED GOODS

[75] Inventor: Bengt L. A. Dehlén, Trelleborg, Sweden

[73] Assignee: Trelleborg, AB, Trelleborg, Sweden

[21] Appl. No.: 424,217

[22] PCT Filed: Mar. 8, 1989

[86] PCT No.: PCT/SE89/00111

§ 371 Date: Oct. 12, 1989

§ 102(e) Date: Oct. 12, 1989

[87] PCT Pub. No.: WO89/08509

PCT Pub. Date: Sep. 21, 1989

[30] Foreign Application Priority Data

Mar. 8, 1988 [SE] Sweden ..... 8800805

[51] Int. Cl.[5] ..... B07B 1/46

[52] U.S. Cl. ..... 209/399; 209/314; 209/403; 209/405; 209/408

[58] Field of Search ..... 209/313, 314, 392, 397-399, 209/401-405, 408, 409, 412

[56] References Cited

U.S. PATENT DOCUMENTS

| | | | |
|---|---|---|---|
| 1,279,630 | 9/1918 | Yoder et al. | 209/399 |
| 2,703,649 | 3/1955 | Cheyette | 209/314 |
| 3,193,098 | 7/1965 | Bingham . | |
| 3,980,555 | 9/1976 | Freissle . | |
| 4,120,784 | 10/1978 | Hassall | 209/399 |
| 4,141,821 | 2/1979 | Wolff . | |
| 4,219,412 | 8/1980 | Hassall . | |
| 4,265,742 | 5/1981 | Bucker et al. | 209/399 |
| 4,661,245 | 4/1987 | Rutherford et al. | 209/399 |

FOREIGN PATENT DOCUMENTS

| | | | |
|---|---|---|---|
| 2754374 | 6/1969 | Fed. Rep. of Germany . | |
| 2924571 | 1/1981 | Fed. Rep. of Germany . | |
| WO84/02290 | 6/1984 | PCT Int'l Appl. . | |
| 74/5092 | 8/1975 | South Africa | 209/399 |
| 208470 | 10/1966 | Sweden . | |
| 0655438 | 4/1979 | U.S.S.R. | 209/365.1 |
| 1343431 | 1/1974 | United Kingdom | 209/397 |

*Primary Examiner*—Kevin P. Shaver
*Assistant Examiner*—Edward M. Wacyra
*Attorney, Agent, or Firm*—Beveridge, DeGrandi & Weilacher

[57] ABSTRACT

A screen formed of a screen frame (10) with screen cloth elements (11) mounted after each other. The screen cloth elements (11) are fixed in the screen frame by snap lock (16, 17; 18). One part (16, 17) of the snap lock is integrally formed with the screen cloth element (11) and arranged adjacent one end thereof. The other part (18) of the snap lock is a thickened portion at the upper edge of a supporting element (19) in the screen frame (10). The opposite end of the screen cloth element rests on a projecting abutment surface (20) on the supporting element (19) and is clamped between this abutment surface and a projecting edge portion (22) of the preceding screen cloth element.

4 Claims, 4 Drawing Sheets

SCREEN FOR PROCESSING CONVEYED GOODS

The present invention relates to a screen of the type comprising screen cloth elements mounted after each other in a screen frame and having a rigid reinforcing frame integrated in a rubber cloth, said screen cloth elements being mounted in the screen frame by snap lock means.

Screens of this type have been extensively used and are known e.g. from SE-B-422,418 and counterpart US-A-4,141,821. A major advantage of these screens is that the separate screen cloth elements can be exchanged when worn more than the other screen cloth elements in the same screening machine. A drawback of this type of prior art screens however is that the dismounting and the mounting of the screen cloth elements are time-consuming operations requiring considerable efforts and equipment. One object of the present invention therefore is to provide a screen of a simpler design preserving the advantages of prior art screens while considerably facilitating mounting and dismounting.

To this end, the present invention relates to a screen of the type stated by way of introduction, which is characterised by the features recited in the main claim. Preferred embodiments are stated in the subclaims.

The invention will be described in more detail hereinbelow with reference to the accompanying drawings, showing an embodiment of a screen according to the invention.

Figure 1:
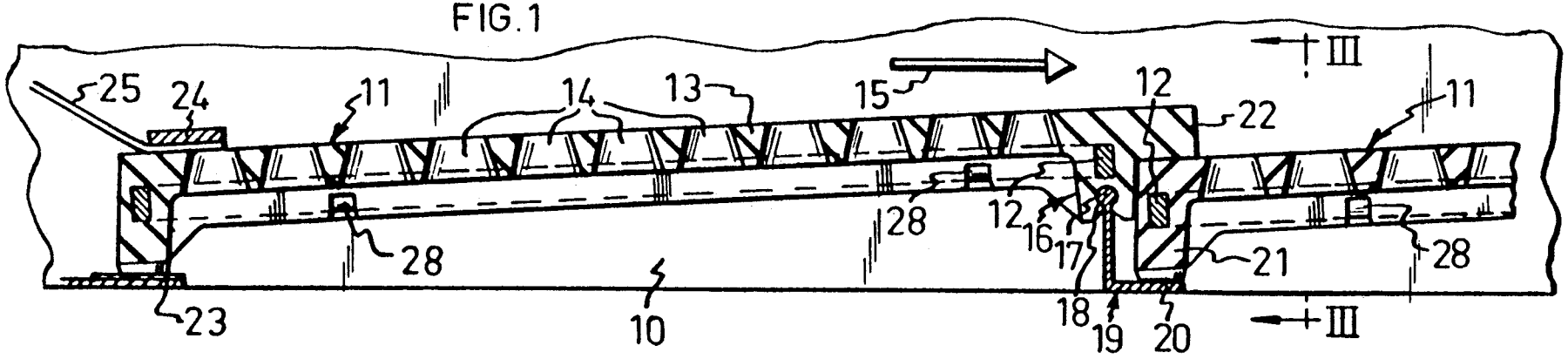
FIG. 1 is a longitudinal section of a part of a screen according to the invention.
Figure 2:
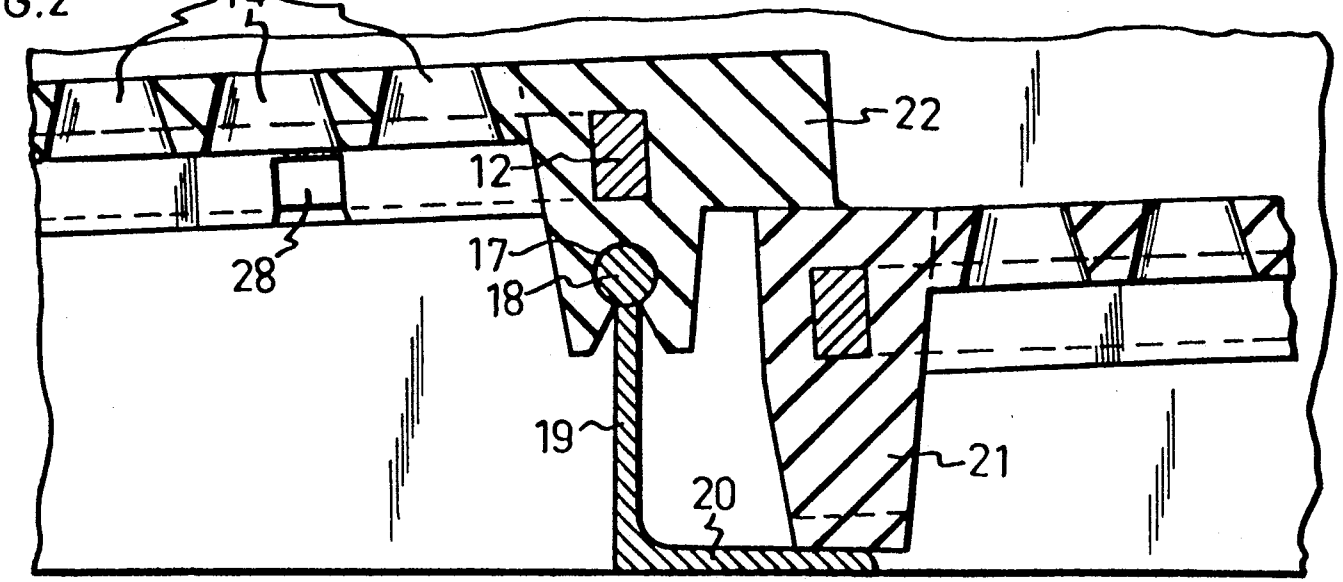
FIG. 2 shows on a larger scale a detail in FIG. 1.

As appears from FIG. 1, the screen according to the invention has a screen frame 10 in which a number of screen cloth elements 11 are arranged after each other. The screen cloth elements have a rigid reinforcing frame 12 integrated in a rubber cloth 13 in which screen holes 14 are punched. The size and the distribution of these holes are optional. As appears from FIG. 1, the ends of the screen cloth elements mounted after each other are overlapping, such that the downstream end, counting in the direction of screening (arrow 15), of one screen cloth element will rest on the upstream end of the following screen cloth element. On the underside of each screen cloth element adjacent its downstream end, there is provided a projection 16 having an undercut groove 17. The details 16 and 17 form one part of a snap lock means for locking the screen cloth element to the screen frame. The other part of the snap lock means is a thickened edge portion 18 of a supporting element 19 included in the screen frame. The supporting element 19 has a projecting flange or abutment surface 20. On this abutment surface rests the upstream end 21 of the following screen cloth element. The relative dimensions of the supporting element, the snap lock means and the screen cloth elements are such that the upstream end of the succeeding screen cloth element will be clamped between the abutment surface 20 and the projecting edge portion 22 of the preceding screen cloth element. By this design, it is possible to reduce the required number of snap lock means for the same number of screen cloth elements in a screen. Also, there is obtained a stepped screening surface turning the material being screened and, thus, improving screening efficiency. The upstream end of the superposed screen cloth element rests on an abutment surface 23 on the screen frame 10 and is retained against this abutment surface by means of a clamping member 24. The clamping member 24 also retains a sliding surface 25 along which the material to be screened descends onto the screen cloth elements.

Figure 6:
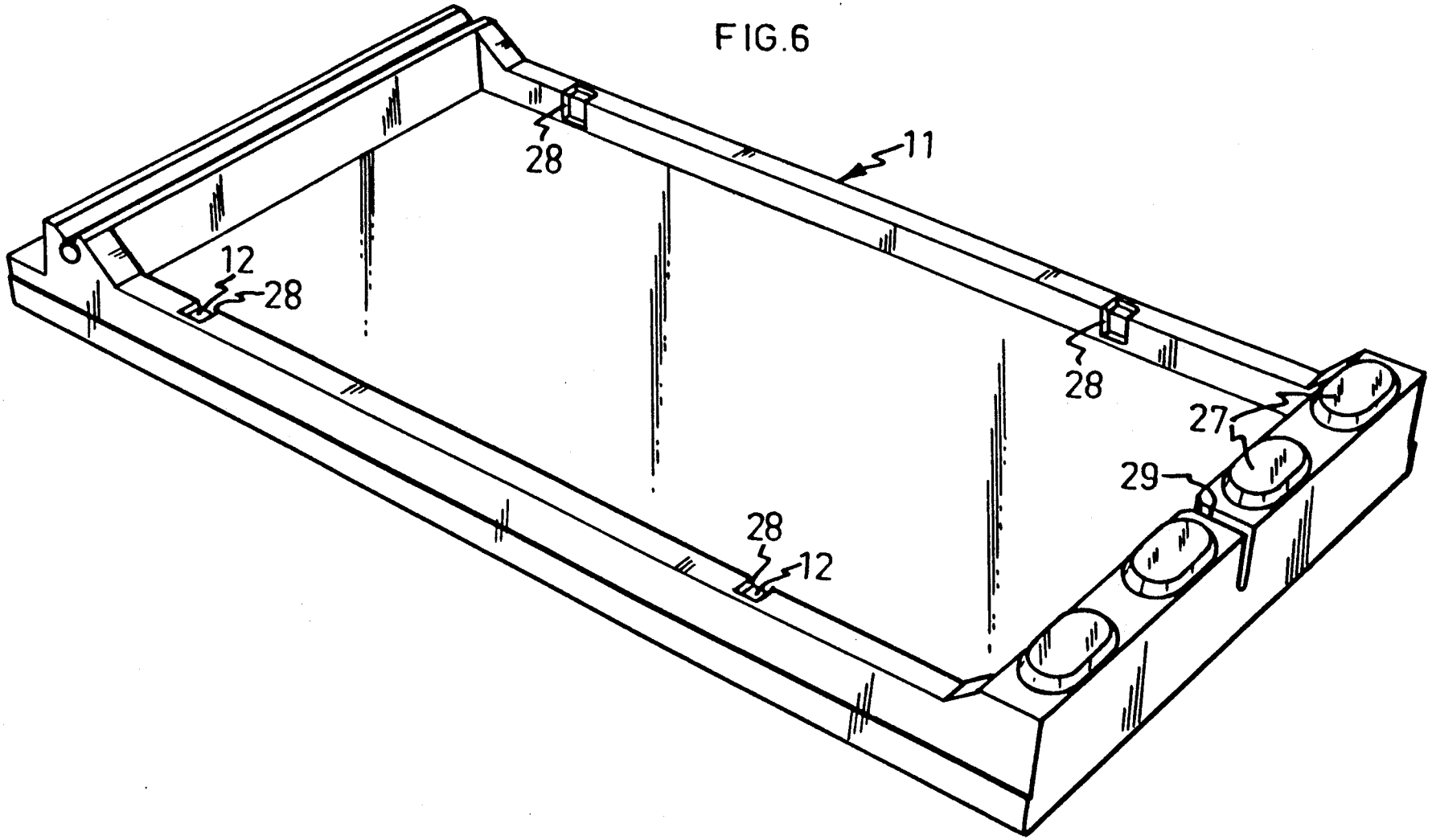
FIG. 6 is a perspective view of this screen cloth element as seen obliquely from below.

As appears especially from FIG. 6, there are provided projecting support bosses 27 at the end of the underside of the screen cloth element which is opposed to the snap lock means 16, 17. The bosses 27, which are spaced from each other, impart a certain yieldingness to the construction, making the clamping of this end of the screen cloth element between the abutment surface 20 and the projecting end 22 of the preceding screen cloth element more efficient.

Figure 3:
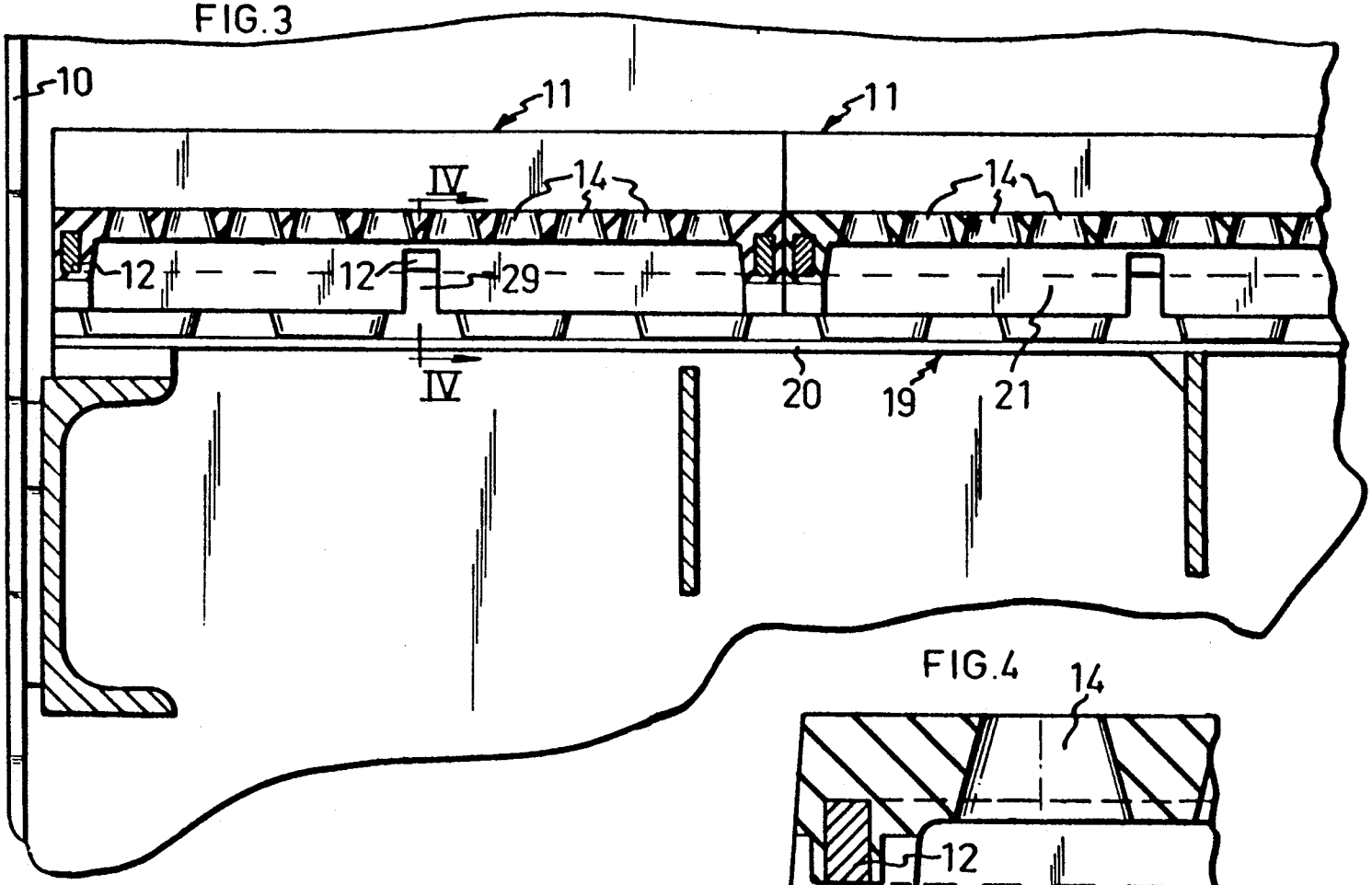
FIG. 3 is a section taken along the line III—III in FIG. 1.
Figure 4:
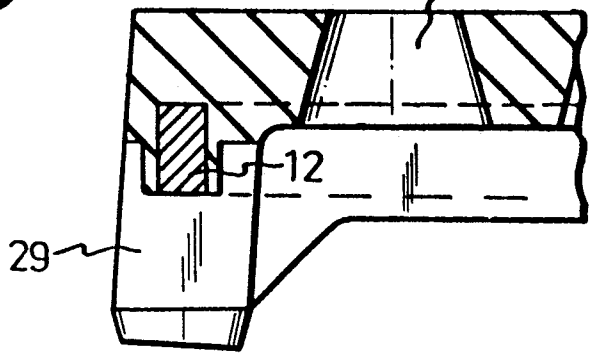
FIG. 4 shows part of a section taken along the line IV—IV in FIG. 3.

When manufacturing the screen cloth element, the frame 12 is placed in a vulcanising mould so as to rest on supports at five points where the mould has inwardly extending abutment surfaces providing recesses on the underside of the forthcoming screen cloth element. Four of these recesses 28 are visible in FIG. 6 and are provided on the inner side of the longitudinal parts of the rigid reinforcing frame of the screen cloth element. The fifth recess is a narrow groove 29 provided at the upstream end of the screen cloth element and shown in greater detail in FIGS. 3 and 4.

Figure 5:
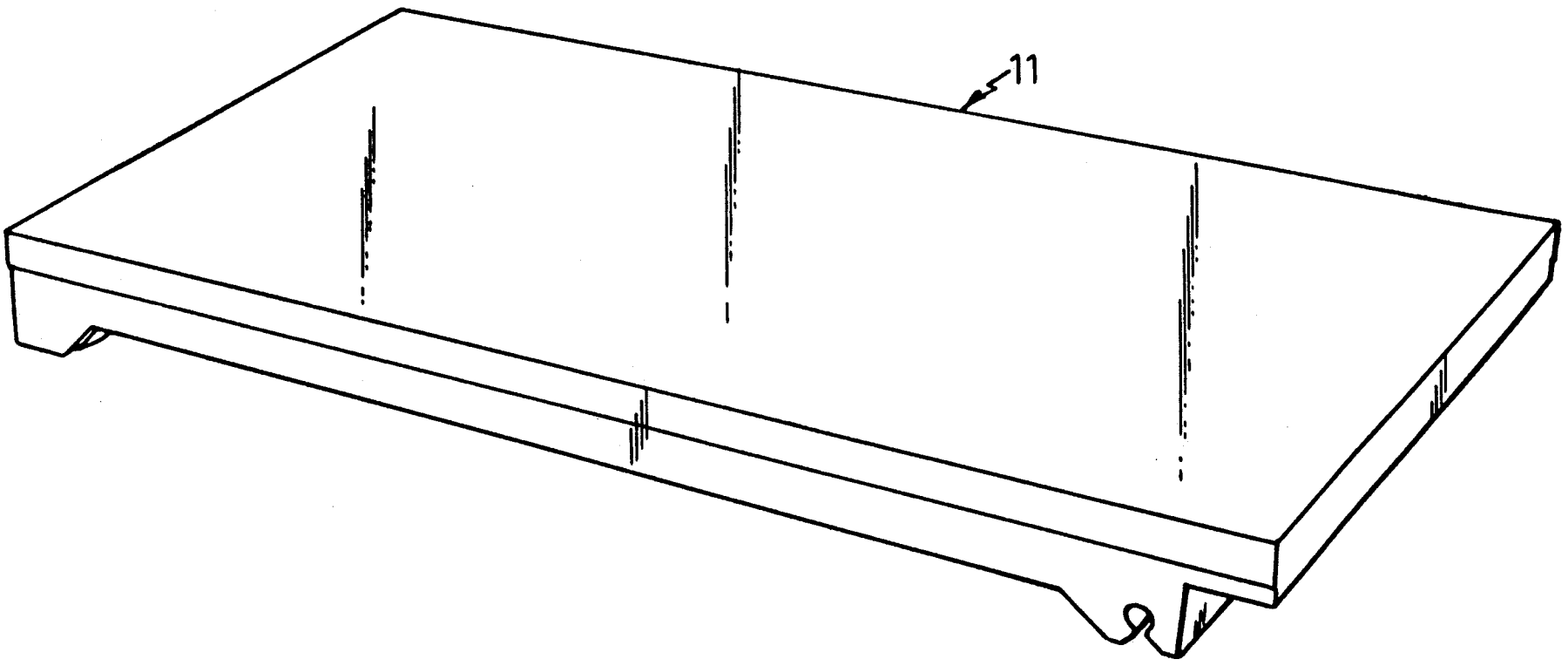
FIG. 5 is a perspective view of a screen cloth element before punching screen holes therein.

A major advantage of this screen construction is that it allows manufacturing the screen cloth elements in standard units of the design shown in FIGS. 5 and 6. The holes in the rubber cloth inside of the frame 12 are then made according to customer requirements.

I claim:

1. A stepped screen comprising screen cloth elements (11) mounted after each other in a screen frame (10) and having a rigid reinforcing frame (12) integrated in a rubber cloth (13), said screen cloth elements being mounted in said screen frame (10) by snap lock means (16, 17; 18), characterised in that the ends of the screen cloth elements (11) mounted after each other are overlapping thereby forming said stepped screen, that one part (16, 17) of said snap lock means (16, 17; 18) is integrally formed with and arranged adjacent one end of the underside of each screen cloth element (11), that the other part (18) of the snap lock means is arranged at the upper edge of a supporting element (19) included in said screen frame (10), and that the other end of each screen cloth element (11) rests on a projecting abutment surface on said supporting element (19).

2. Screen as claimed in claim 1, characterised in that the relative dimensions of the supporting element (19), the snap lock means (16, 17; 18) and the screen cloth elements (11) are such that said other end of each screen cloth element (11) is clamped between the abutment surface (20) of the supporting element (19) and the underside of the adjacent screen cloth element (11).

3. Screen as claimed in claim 1, characterised in that the part (16, 17) of the snap lock means (16, 17; 18) provided on the underside of the screen cloth element (11) comprises an undercut groove (17), and that the part (18) of the snap lock means provided on the supporting element (19) comprises a thickened edge portion (18) of the supporting element.

4. Screen as claimed in claim 1, characterised in that each screen cloth element (11), on the underside of said other end is provided with support bosses (27) spaced from each other and projecting from the underside of the screen cloth element.

* * * * *